United States Patent [19]

Luque

[11] 4,401,129

[45] Aug. 30, 1983

[54] COMB AND CUT BATON

[76] Inventor: Fortino C. Luque, 8471 Suva, Downey, Calif. 90240

[21] Appl. No.: 299,818

[22] Filed: Sep. 8, 1981

[51] Int. Cl.[3] ..... A45D 24/36

[52] U.S. Cl. ..... 132/45 R

[58] Field of Search ..... 132/45 R; 30/30, 31; 7/6.1

[56] References Cited

U.S. PATENT DOCUMENTS

| | | | |
|---|---|---|---|
| 1,190,182 | 7/1916 | McDonough | 30/30 |
| 1,975,328 | 10/1934 | Madore | 30/30 |
| 2,152,898 | 4/1939 | Madure | 30/30 |
| 2,620,559 | 12/1952 | Verdi | 30/30 |
| 3,106,020 | 10/1963 | Tape | 30/30 |
| 3,409,981 | 11/1968 | Beverly | 30/30 |
| 3,463,170 | 8/1969 | McCullough | 132/113 |
| 3,536,080 | 10/1970 | Player | 132/45 R |

*Primary Examiner*—Gregory E. McNeill

[57] ABSTRACT

A combination comb and razor, so that both may be held in a single hand; and including a handle portion between the comb and razor, for being grasped by the hand, or being twirled end to end therein, for selectively moving either the comb or razor into an operative position, and the comb including teeth of different thicknesses.

1 Claim, 17 Drawing Figures

COMB AND CUT BATON

This invention relates generally to combs, such as are used for combing the hair. More specifically, it relates to combination combing and hair trimming devices.

It is well known that devices have been developed, in the past, for trimming the hair while being combed, so that the hair is thus constantly being maintained at a proper length, each time that it is combed. A search of the records indicate that all such devices have been designed with a comb and razor being on the same end of a comb handle, so as to be near each other for interchangeable use; however, it is believed that such nearness may cause confusion to a user working on his own hair, because the person cannot always see clearly enough, in a mirror, whether the comb or the razor is in the operative position. This situation is, accordingly, in need of an improvement.

A principal object of the present invention is to provide a hair grooming implement, which includes a rattail comb, fitted with a razor on its handle, so that simply by turning the implement, end to end, in a hand, either the comb or the razor is moved into operative position, for either combing or trimming the hair, and which is just as easy to do as flipping or twirling a baton around, between the fingers of a person's hand, so that, repeatedly, either may be frequently used during the progress of cutting the hair.

Another object is to provide a comb and cut baton, which can be used either by a beautician working on a person, or which can be used by an individual working alone, to cut his own hair.

Yet another object is to provide a comb and cut baton, in which the razor is adjustable, so that the implement may be used by either a right or left handed person.

Other objects of the present invention are to provide a comb and cut baton, which is simple in design, inexpensive to manufacture, rugged in construction, easy to use and efficient in operation.

These, and other objects, will be readily evident, upon a study of the following specification, and the accompanying drawings, wherein.

Figure 1:
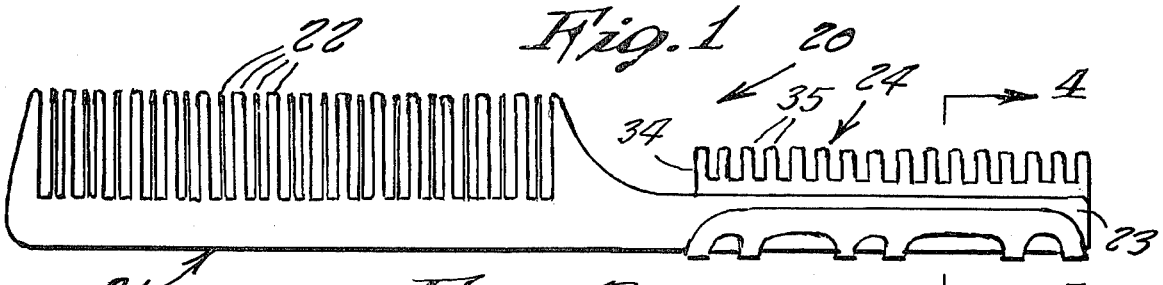
FIG. 1 is a side view of the invention.
Figure 2:
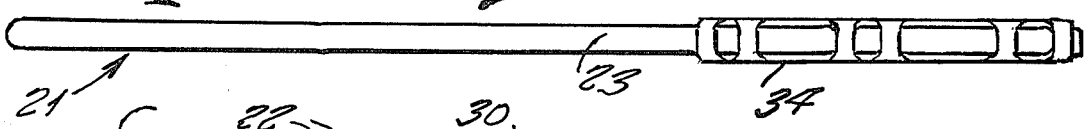
FIG. 2 is a bottom view thereof.

Referring now to the drawings in greater detail, and more particularly to FIGS. 1 through 6 thereof, at this time, the reference numeral 20 represents one design of comb and cut baton, according to the present invention, wherein thre is a comb member 21, molded of plastic, hard rubber or the like, and which includes a row of teeth 22, along one longitudinal side edge, and which are located toward one end of the comb member, while a handle 23 extends toward an opposite end of the comb member.

In the present invention, a razor 24 is included on the comb handle, by means of a wide, elongated groove 25, formed on the handle, and extending from an end 26 thereof. A narrow slot 27, along one longitudinal edge 28 of the handle, communicates throughout its length with the groove. The groove and slot together form an opening 29, into which a replaceable single edge razor blade 30 is slideably receivable. The blade consists of an elongated flat steel plate 31, having a sharpened, elongated, cutting edge 32, while the opposite longitudinal edge is enclosed inside a folded over, U-shaped plate 33. When the razor blade is mounted in the opening 29, the cutting edge 32 remains exposed, as shown in FIGS. 5 and 6.

Figure 4:
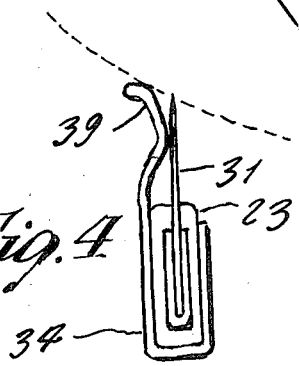
FIG. 4 is a cross-sectional view, taken on line 4—4 of FIG. 1, shown enlarged, and illustrating how the guard lip, along one side of the blade, protects against a deep cut by the blade cutting edge.
Figure 5:
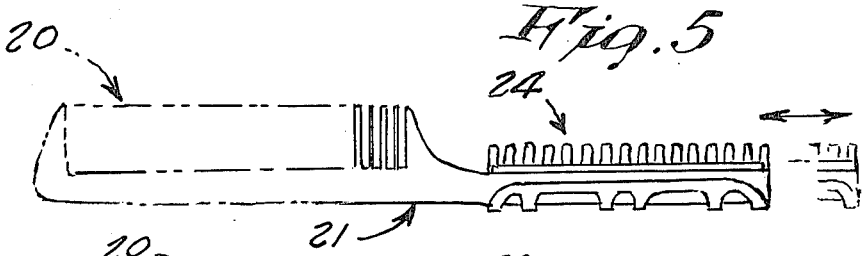
FIG. 5 is a side view, showing how the blade and guard is slideable outwardly on the comb handle, so as to accommodate a person with a larger hand.
Figure 6:
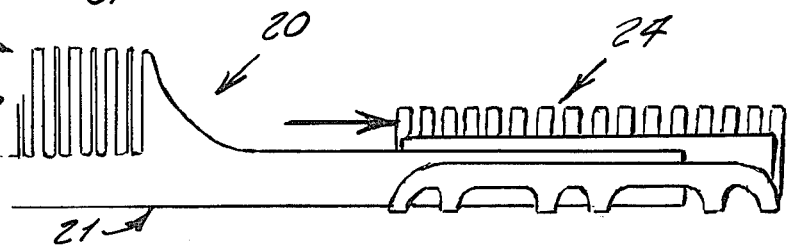
FIG. 6 is an enlarged detail of FIG. 5, showing the guard and blade in outwardly slided position for the larger hand.

A U-shaped razor guard 34, made of spring steel material, clips around the handle 23, and includes a tooth-notched edge 35, for positioning alongside the cutting edge 32, as shown in FIGS. 4, 5 and 6, so as to protect a user against any excessive cut by the cutting edge.

As indicated in FIGS. 5 and 6, the razor may be only partly slided on the comb handle 23, so as to accommodate a large handed person in grasping that portion of the handle that is located between the razor and the comb teeth.

Figure 3:
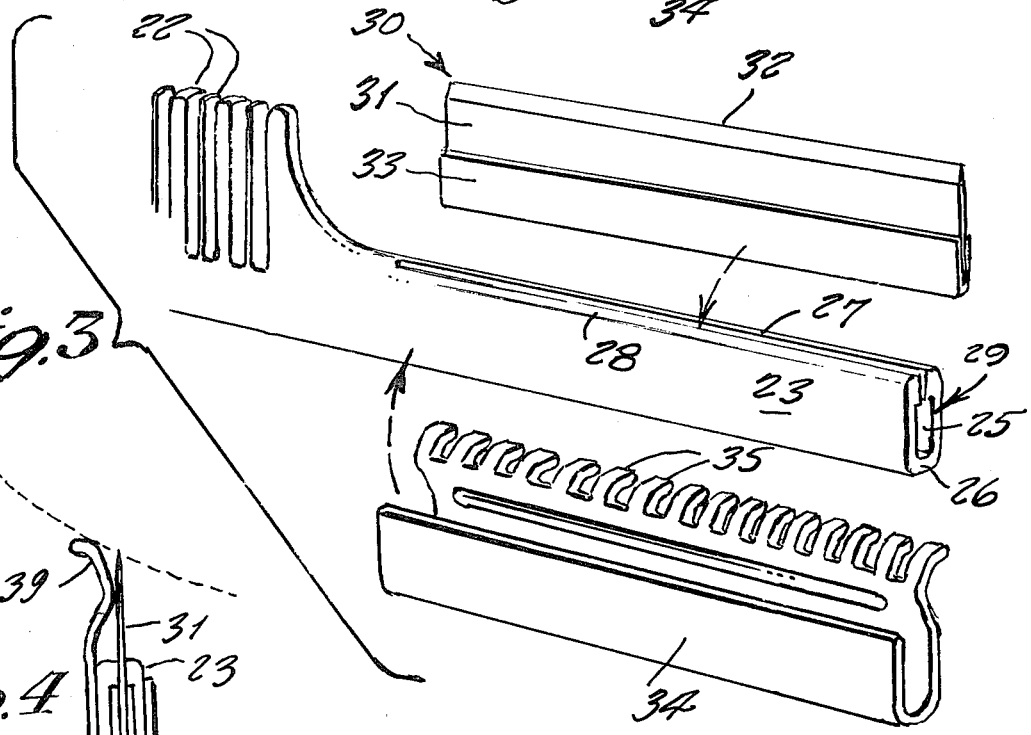
FIG. 3 is a detail view of the blade and guard.

As best shown in FIGS. 1 and 3, each alternate tooth is thick in width, while each tooth therebetween is thin in width. Thus, the entire row has both the characteristics of a coarse and a fine toothed comb.

In operative use, when thinning the hair with the razor, and also shaping the hair therewith, the razor guard, tooth-notched edge must be on the same side as the beautician or barber. The thumb is placed in the slot, and the fingers are wrapped around the edge 36 of the comb member. A strand of hair is held straight out, between the middle and index fingers. The razor is then placed flat (not erect), approximately one or two inches from the scalp, depending upon the hair texture. Then, pressure is applied on the back of the razor (not on an edge thereof), and short, steady strokes are made on the hair, in a direction toward the hair ends. After combing, the hair ends are tapered.

Thus, the single combination tool replaces the use of two separate tools, so that the hands of the operator are not cluttered, holding them. By flipping the comb and cut baton, end to end, either of the tools are thus brought into position, for use to comb or to cut.

Figure 7:
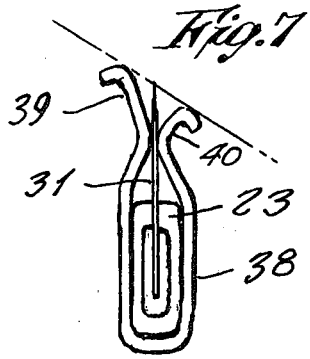
FIG. 7 is a view similar to FIG. 5, and showing another form of the invention, in which guard lips on each side of the blade further protect the hand of a person grasping the comb handle, so as not to get cut.
Figure 8:
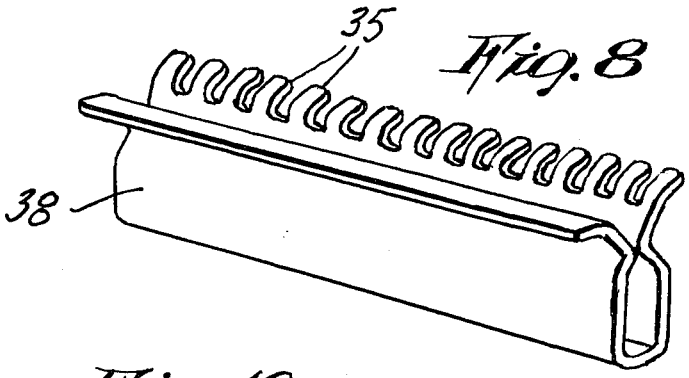
FIG. 8 is a perspective view of the guard used in FIG. 7.

In a modified design 37 of the invention, shown in FIGS. 7 and 8, the comb and cut baton includes a razor guard 38, in which the razor blade is more completely enclosed, for greater safety, between two projecting lips 39 and 40, instead of only the single projecting lip 39, shown in FIG. 4.

Figure 9:
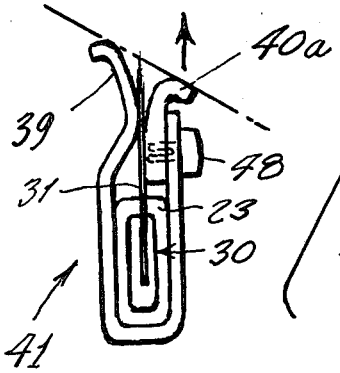
FIG. 9 is a view similar to FIG. 7, and showing a further modified form of the invention, in which the second lip of the guard is extendible, so as to protect a person's hand fully, from getting cut on the blade, when the comb handle is being grasped.
Figure 10:
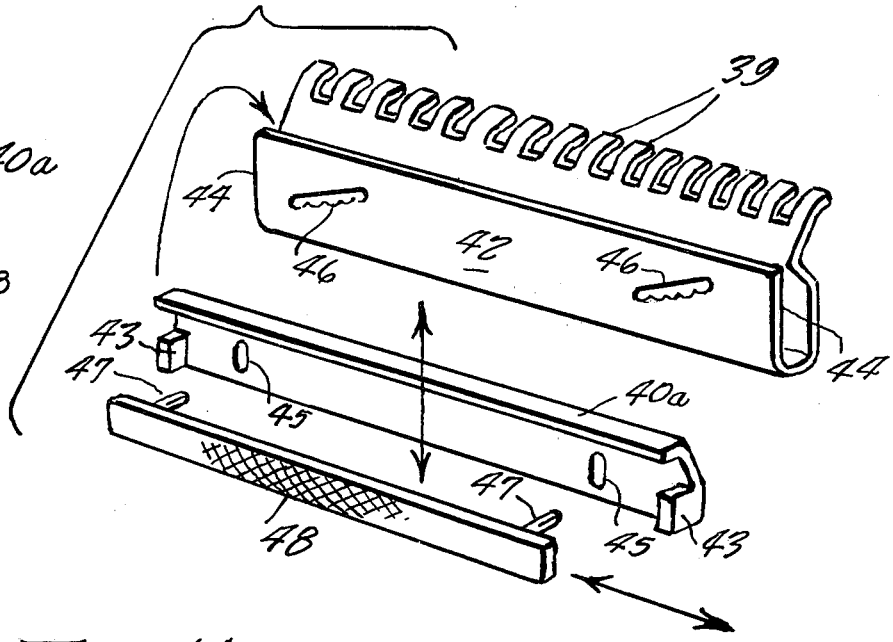
FIG. 10 is a perspective view of the guard components used in FIG. 9.

In a further modified design of this, the razor 41 of FIG. 9 includes a razor guard 42, having an adjustable second lip 40*a*, that is a separate member, selectively able to enclose fully the razor blade cutting edge, for protecting a hand nearby grasping the comb handle. In this design, the second lip member 40*a* includes a sideward tab 43 at each end, for extending around side edges 44 of the guard, and transverse slots 45 of the second lip member align with diagonal slots 46 of the guard, so as to receive snap pins 47 of a knurlled bar 48.

Figure 11:
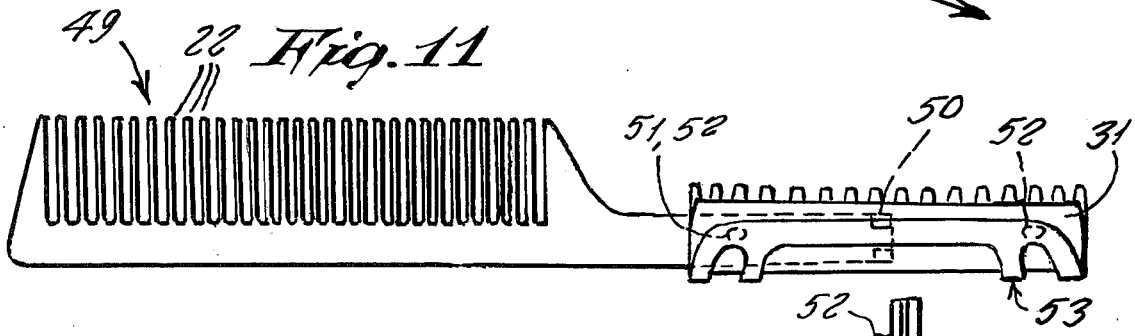
FIG. 11 is a side view of still another form of the invention.
Figure 12:
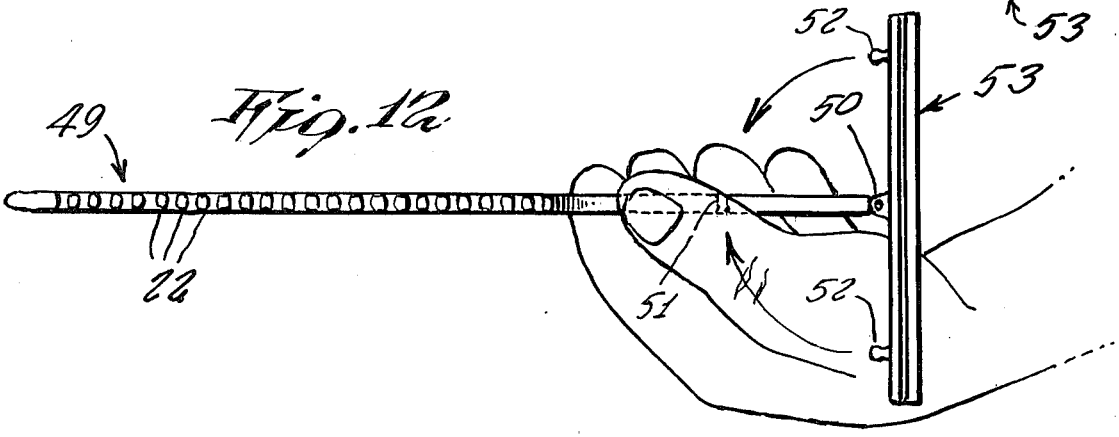
FIG. 12 is a top view thereof, and showing the cutting blade unit pivotable on an end of the comb handle, so that it may be pivoted to either side thereof, in order to accommodate either a left or right handed person, and wherein the unit may be left at right angles thereto, when not in use, so as not to interfere with a person's hand grasping the comb handle.

FIGS. 11 and 12 illustrate a comb and cut baton 49, in which the razor is pivotally mounted on an end of the comb handle, by a hinge 50, so that the razor is thus adjusted for either a left or right handed person. A single transverse hole 51, through the comb handle, is adaptable to receive either snap pin 52 at opposite ends of the razor 53.

Figure 13:
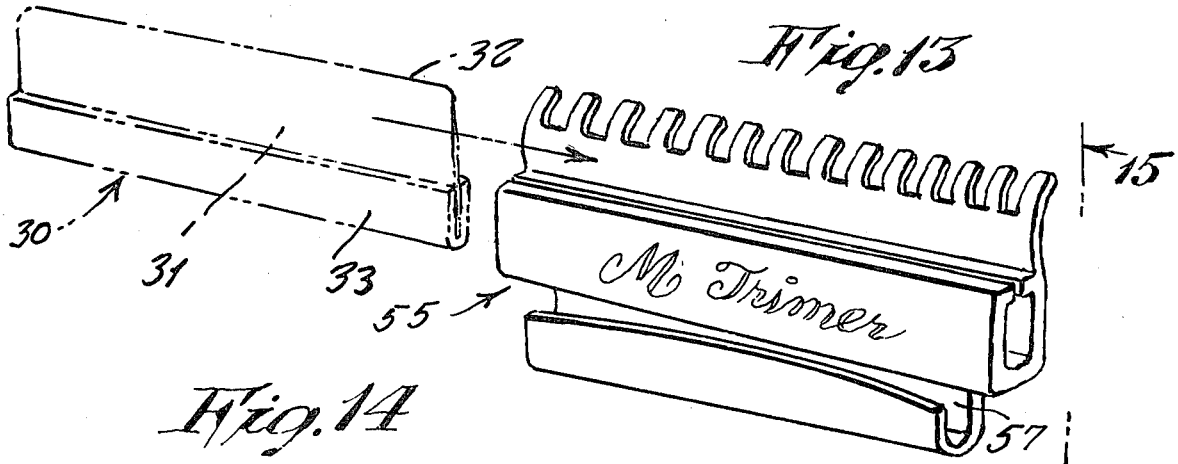
FIG. 13 is a perspective view of still another design of the invention.
Figure 14:
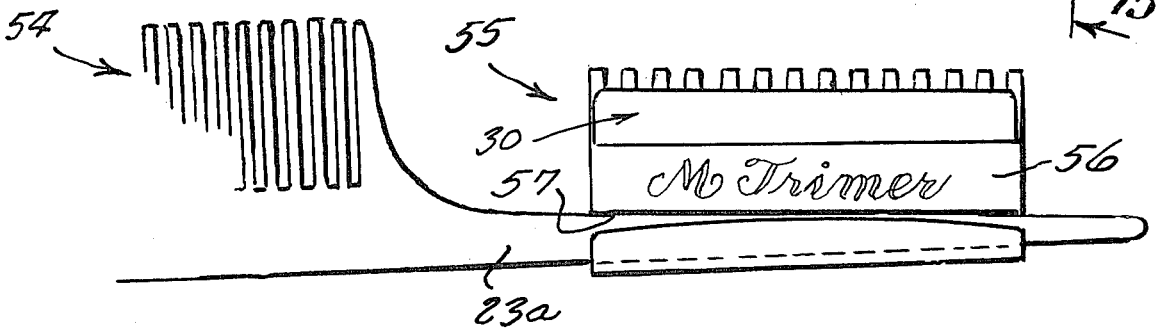
FIG. 14 is a side view thereof, shown installed on a rattail comb.
Figure 15:
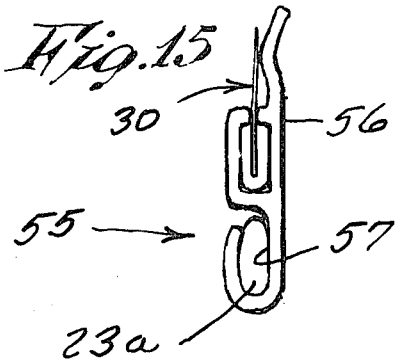
FIG. 15 is an end view, in direction 15—15 of FIG. 13.

FIGS. 13 through 15 illustrate a cut and comb baton 54, in which the comb handle 23*a* tapers to its outward end, and the razor 55 includes a guard 56, having a groove 57 for fitting on the tapered handle, and which is separate from the groove and slot that receives the razor blade.

Figure 16:
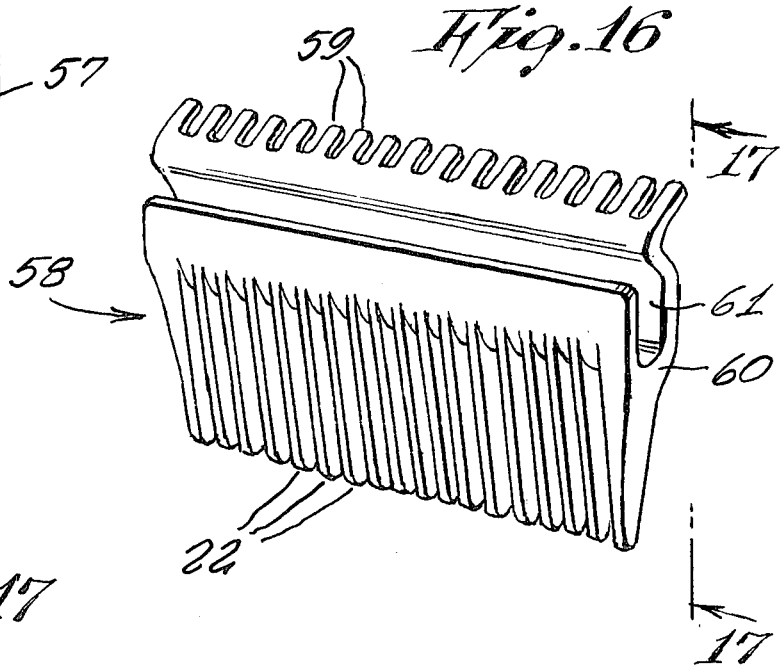
FIG. 16 is a perspective view of still a further design of the invention.
Figure 17:
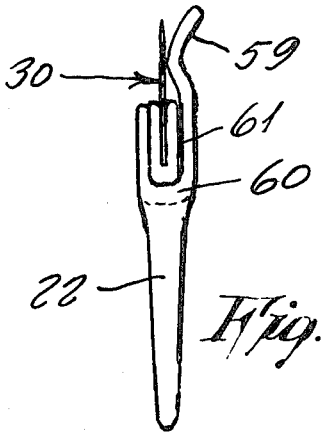
FIG. 17 is an end view thereof, taken in direction 17—17 of FIG. 16.

FIGS. 16 and 17 illustrate yet another design of comb and cut baton 58, in which the guard 59, for the razor blade, is formed directly on the backbone 60 of the comb, and from which the comb teeth extend directly, so that the implement is thus more compact, for easier transportation and storage. Razor blade 30 fits in a recess 61.

While various changes may be made in the detail construction, it is understood that such changes will be within the spirit and scope of the present invention, as is defined by the appended claims.

What I now claim is:

1. A comb and cut baton, comprising, in combination, a comb member and a razor on said comb member; said comb member including a row of teeth, each alternate one of which is relatively thin, while each tooth therebetween is relatively thick, and said comb member having an elongated handle at one end; said razor including a single edge razor blade replaceably held in an opening formed along said handle, and a razor guard slidably fitted around said handle; said razor guard having a serrated edge held in juxtaposition with a cutting edge of said blade, so as to form a first lip on one side of said razor blade, a second lip member for positioning adjacent on opposite side of said blade, a plurality of transverse slots on said second lip member for selective alignment with a plurality of toothed, diagonal slots on said razor guard, and a knurlled bar alongside said second lip member, and a plurality of snap pins formed on said bar being received in said transverse and diagonal slots for securement of said second lip member on said razor guard in selected position.

* * * * *